US011013067B2

(12) United States Patent
Lollar et al.

(10) Patent No.: US 11,013,067 B2
(45) Date of Patent: May 18, 2021

(54) SUPPORT INSULATORS FOR OPEN COIL ELECTRIC HEATERS AND METHOD OF USE

(71) Applicant: TUTCO, LLC, Cookeville, TN (US)

(72) Inventors: James Patrick Lollar, Cookeville, TN (US); Devin Ridley, Cookeville, TN (US)

(73) Assignee: TUTCO, LLC, Cookeville, TN (US)

( * ) Notice: Subject to any disclaimer, the term of this patent is extended or adjusted under 35 U.S.C. 154(b) by 288 days.

(21) Appl. No.: 15/974,743

(22) Filed: May 9, 2018

(65) Prior Publication Data

US 2018/0332668 A1 Nov. 15, 2018

Related U.S. Application Data

(60) Provisional application No. 62/503,481, filed on May 9, 2017.

(51) Int. Cl.

| | |
|---|---|
| ***H05B 3/06*** | (2006.01) |
| ***H05B 3/32*** | (2006.01) |
| ***H05B 3/16*** | (2006.01) |

(52) U.S. Cl.

CPC ..... *H05B 3/16* (2013.01); *H05B 3/06* (2013.01); *H05B 3/32* (2013.01); *H05B 2203/022* (2013.01)

(58) Field of Classification Search

None

See application file for complete search history.

(56) References Cited

U.S. PATENT DOCUMENTS

| | | | | |
|---|---|---|---|---|
| 5,578,232 | A * | 11/1996 | Engelke | H05B 3/16 219/532 |
| 5,925,273 | A | 7/1999 | Sherrill | |
| 6,259,070 | B1 | 7/2001 | Audet | |
| 6,509,554 | B2 * | 1/2003 | Howard | H05B 3/06 174/138 J |
| 7,075,043 | B2 | 7/2006 | Howard et al. | |
| 2002/0023918 | A1 * | 2/2002 | Howard | H05B 3/32 219/536 |
| 2002/0036199 | A1 * | 3/2002 | Howard | H05B 3/16 219/532 |
| 2006/0000824 | A1 * | 1/2006 | Howard | H05B 3/16 219/548 |
| 2006/0118545 | A1 | 6/2006 | Sherrill et al. | |
| 2014/0069911 | A1 * | 3/2014 | Lollar | H05B 3/32 219/531 |

* cited by examiner

*Primary Examiner* — Joseph M. Pelham

(74) *Attorney, Agent, or Firm* — Clark & Brody LP

(57) ABSTRACT

A support insulator for an open coil electric heater includes an insulator body having at least one coil support portion and plate attachment slots. The support insulator has an arm extending from the insulator body, the arm having a slot on an end thereof. Depending on the mounting of the support insulator, the slot can receive a resistance wire as a portion of a coil break-turn, a wire as part of a coil section, a part of a lead wire, or a part of a run of resistance wire that is not a coil break-turn or coil section.

19 Claims, 10 Drawing Sheets

SUPPORT INSULATORS FOR OPEN COIL ELECTRIC HEATERS AND METHOD OF USE

This application claims priority under 35 USC 119(e) based on provisional application No. 62/503,481 filed on May 9, 2017 and is herein incorporated by reference in its entirety.

FIELD OF THE INVENTION

The present invention relates to support insulators that are designed to support wires and the like in an open coil electric heater, and particularly, a coil break-turn.

BACKGROUND ART

In the prior art, it is well known to use support insulators to hold portions of a resistance wire used in an open coil electric heater. U.S. Pat. Nos. 5,925,273 and 7,075,043 are examples of such support insulators.

One common open element or (open coil) electric heater industry problem involves what is called a cross-over problem, the crossing over a metal plate. When a coil needs to be routed from one side of a metal plate to the other, the coil is typically formed in what is called a "break-turn"; it is then re-routed to the opposite side of the metal plate. The concern here is the open coil element may touch the metal plate under extreme conditions or unforeseen damage. The element could short to the metal plate causing a failure or possible safety concern.

FIG. 1 shows a schematic of a prior art oil coil electric heater assembly designated by the reference numeral 200 and showing conventional ceramic coil support insulators 201 mounted to a metal plate 203 on one end thereof and supporting a respective pair of coils 205 on each other end. Also shown is the coil break-turn 207, the cross-over point 209, and the plate attachment slots 211. These types of heaters are well known and examples of such types are disclosed in U.S. Pat. No. 5,925,273 to Sherrill, which is incorporated by reference in this disclosure. As these heaters are well known, a detailed description of all of their component parts is not necessary for understanding of the invention.

There is a need to avoid the shorting that can result from the coil break-turn as well as a need to provide more flexibility in terms of support provided by the prior art support insulators.

SUMMARY OF THE INVENTION

The present invention relates to an improved open coil electric heater support insulator and method of use.

In one embodiment, the support insulator includes an insulator body having a longitudinal axis and a bottom portion including metal plate attachment slots. The insulator body further includes a first coil support portion having at least one first coil support slot therein, and optionally, a second coil support portion having at least one second coil support slot therein. At least one extension arm is provided that extends from the insulator body, the at least one extension arm having at least one extension arm slot at an end thereof.

The support insulator can have a plurality of extension arm slots and/or a plurality of bottom portions and/or a plurality of extension arms. The support insulator extension arm slot can extend in a direction parallel to the longitudinal axis, perpendicular to the longitudinal axis, or at an angle between 0 and 90° with respect to the longitudinal axis of the support insulator.

In another embodiment, the insulator body comprises first and second coil support portions and the first and second coil support portions can be offset from each other with respect to the longitudinal axis.

The extension arm can also include a coil support portion, and optionally include a configuration matching a configuration of either the first or second coil support portion.

Another embodiment of the open coil electric heater support insulator has an insulator body having at least one open ended channel therein, with the insulator body having an outer surface terminating in two outer ends, the outer surface having a groove extending between each recess. The groove is adapted to engage a metal plate of an electric heater and a means for locking the support insulator into the cutout. The at least one open ended channel is adapted to receive a resistance wire of an open coil electric heater, the insulator body separating the resistance wire from the metal plate to avoid a short circuit of the open coil electric heater.

In a further variation, each outer end of the insulator body has a recess on an outer surface thereof, each recess adapted to engage a tab of the metal plate for locking the insulator body to the metal plate. The insulator body could also have a plurality of open-ended channels.

The invention also includes an open coil electric heater metal plate assembly comprising a metal plate having a cut out on an end thereof and the open coil electric heater support insulator having the open ended channel, the cut out sized to receive the open coil electric heater support insulator.

The metal plate can include a pair of slots therein, the slots surrounding the cut out and forming a pivot area therebetween, the pivot area allowing a portion of the metal plate adjacent the slots to move about the pivot area so that a position of the open coil electric heater support insulator mounted in the cut out can be moved to receive a resistance wire or coil section in the channel.

The invention also includes a method of securing a coil break-turn in an open coil electric heater. In one mode, the method involves mounting a support insulator on a metal plate of the heater, the support insulator comprising an insulator body having a longitudinal axis and a bottom portion including metal plate attachment slots, the insulator body further comprising: a first coil support portion having at least one first coil support slot therein; optionally, a second coil support portion having at least one second coil support slot therein; and at least one extension arm extending from the insulator body, the at least one extension arm having at least one extension arm slot at an end thereof on a metal plate of the open coil electric heater and receiving a part of coil breakturn in the extension arm slot.

In a second mode, the method involves mounting the support insulator having the open ended channel on the metal plate of a heater and receiving a part of the coil breakturn in the channel.

In the methods of the invention, the coil break-turn can be a wire or a section of coil.

Each of the two support insulator or insulators are also part of an open coil electric heater.

DETAILED DESCRIPTION OF THE INVENTION

In one embodiment, the invention provides improved support insulators for open coil electric heaters that are especially configured to support both the coil of the heater and provide shorting protection for the break-turn portion of the coil.

Figure 2A:
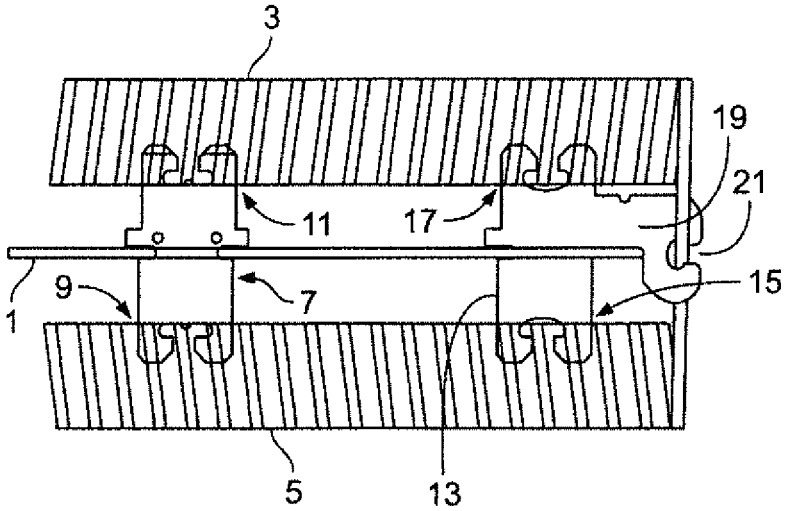
FIG. 2A is a schematic drawing of a portion of an open coil heater showing a first embodiment of the invention.
Figure 2B:
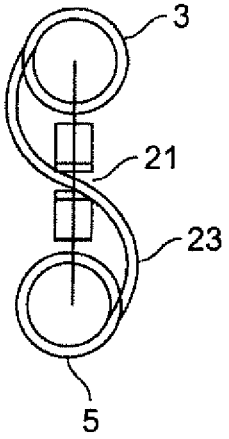
FIG. 2B is a side view of FIG. 2A.
Figure 3A:
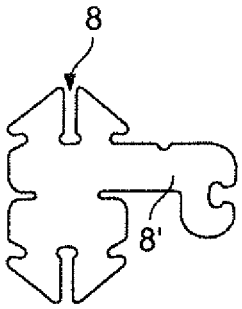
FIGS. 3A-3D show a first set of embodiments of the support portions of the support insulator of FIG. 1.
Figure 3B:
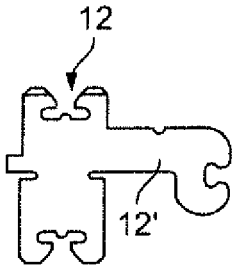
Figure 3C:
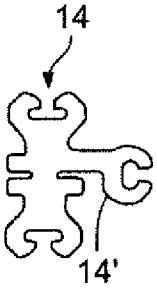
Figure 3D:
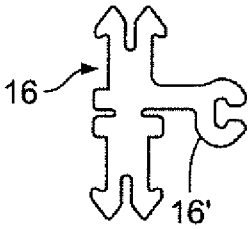

FIGS. 2A and 2B shows one embodiment of the invention. A section of an open coil electric heater is shown that includes a metal plate 1, a pair of coil sections 3 and 5, and a conventional ceramic support insulator 7. The support insulator 7 has first and second coil support portions 9 and 11 that engage the coil sections 3 and 5, respectively, to hold them in place. The support insulator is also attached to the metal plate 1, although different configurations of support insulators can be used as well.

Also shown in FIGS. 2A and 2B is a support insulator 13. The support insulator 13 has two coil support portions 15 and 17, that are configured in the same way as the support portions 9 and 11 of the support insulator 7 for coil support.

The support insulator 13 has an extension arm 19 with a slot 21 at an end thereof. With the support insulator 13 in place, the part of the resistance wire, i.e., the coil breakturn 23, can seat in the slot 21 and it is prevented from contacting the metal plate 1 and causing a short circuit.

The inventive support insulator extends the ceramic of the insulator body in such a way as to allow a slot to be included, and the slot is located so that the break-turn in the coil can easily be routed through this slot area. The slot 21 holds the coil wire break-turn in place to prevent movement and secure the cross-over location. This helps to prevent a lack of electrical clearance that can cause an electrical short.

While one type of coil support portions is depicted in FIGS. 2A and 2B, the support insulator can have any kind of coil support portions and examples of different kinds are shown in FIG. 3(A-D), each designated by reference numerals 8, 12, 14, and 16. As shown in these figures, the coil support portion 8', 12', 14', and 16' of the support insulators can have different size and shape slots and notches to engage a coil section. While the support insulators are shown with a pair of coil support portions, the support insulator can have just one coil support portion.

Figure 4A:
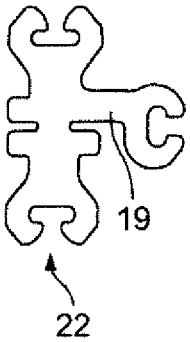
FIGS. 4A-4B show a second set of embodiments of the support portions of the support insulator of FIG. 1.
Figure 4B:
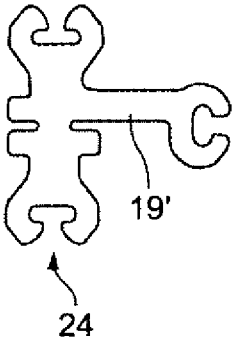
Figure 5A:
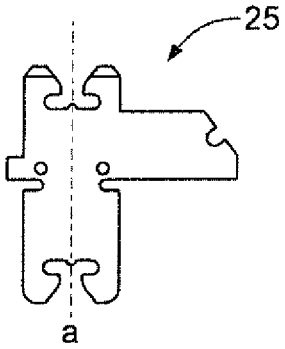
FIGS. 5A-5E shows a third set of embodiments of the support portions of the support insulator of FIG. 1.
Figure 5B:
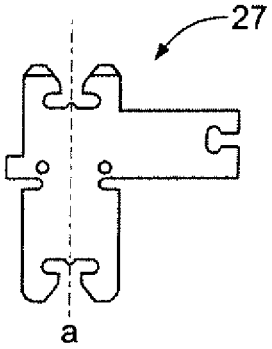
Figure 5C:
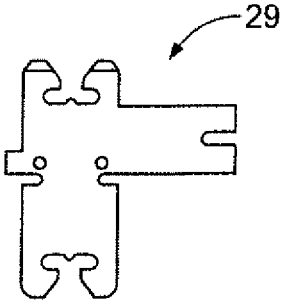
Figure 5D:
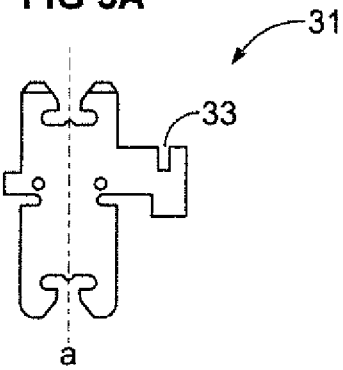
Figure 5E:
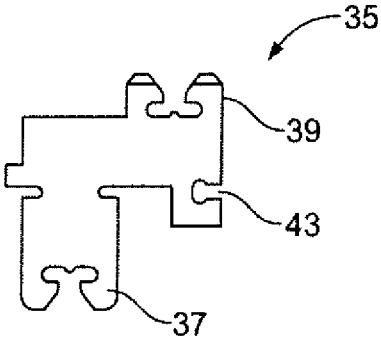

The dimension DIM of the extension arm 19 can vary as well as shown in FIG. 4, where DIM 1 for the extension arm 19 of the support insulator 22 is less than the DIM 2 of extension arm 19' for the support insulator 24.

The configuration and orientation of the slot 21 can also vary. FIGS. 5A-E show different extension arm configurations 25, 27, 29, 31, and 35. Configuration 25 shows the slot at an angle with respect to the longitudinal axis of the support insulator. Configuration 27 shows the slot having a direction generally perpendicular to the longitudinal axis of the support insulator. Configuration 29 shows a straight slot configuration as opposed to the keyhole configuration in configuration 27.

Configuration 31 shows a slot 33 that is parallel to the longitudinal axis "a" of the support insulator. With configuration 31, the additional support could be provided for the coil itself instead of the coil break-turn as shown in FIGS. 2A and 2B.

Configuration 35 shows the coil support portions 37 and 39 offset from each other so that the extension arm 41 has both a slot 43 for the coil break-turn and the coil support portion 39.

Figure 1:
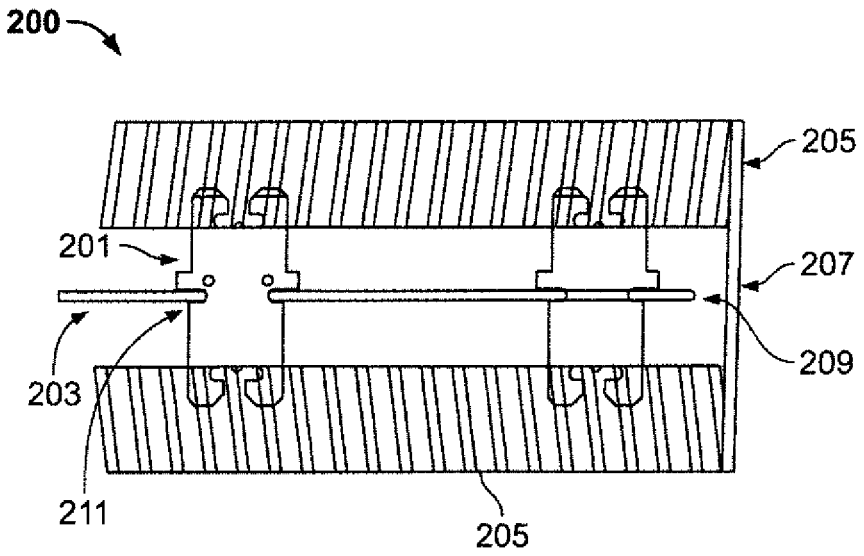
FIG. 1 (Prior Art)
FIG. 1 is a schematic drawing of a prior art heater coil assembly showing support insulators supporting coils.
Figure 6A:
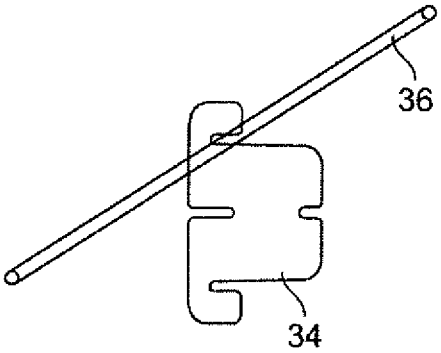
FIG. 6A (Prior Art)
FIG. 6A shows a prior art support insulator holding a resistance wire.
Figure 6B:
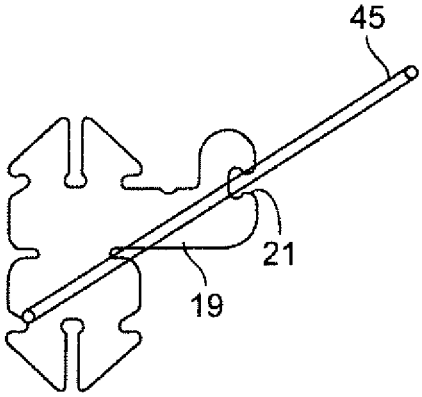
FIG. 6B shows a support insulator according to the invention holding a resistance wire.

FIG. 6A shows a prior art support insulator 34 or standoff disclosed in U.S. Pat. No. 7,075,043 supporting a resistance wire 36. This support insulator is primarily designed to engage bare resistance wire and/or lead wires and not to take the place of a conventional support insulator like that shown in FIG. 1. The support insulator 13 shown in FIG. 6B can be used in the same type of applications as the support insulator shown in FIG. 6A, i.e., provide support for a run of wire 45 using the extension arm 19 and its slot 21.

Figure 7A:
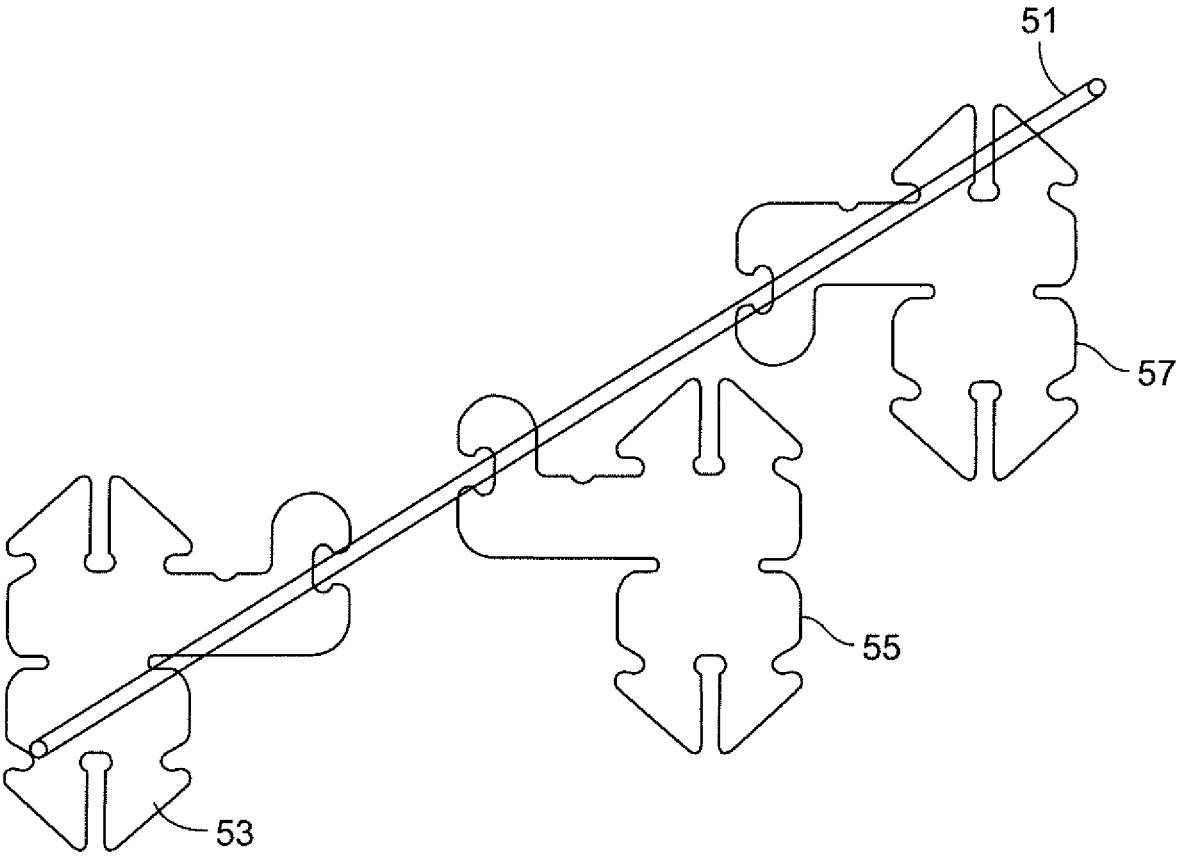
FIG. 7A shows different support insulators holding the same resistance wire.
Figure 7B:
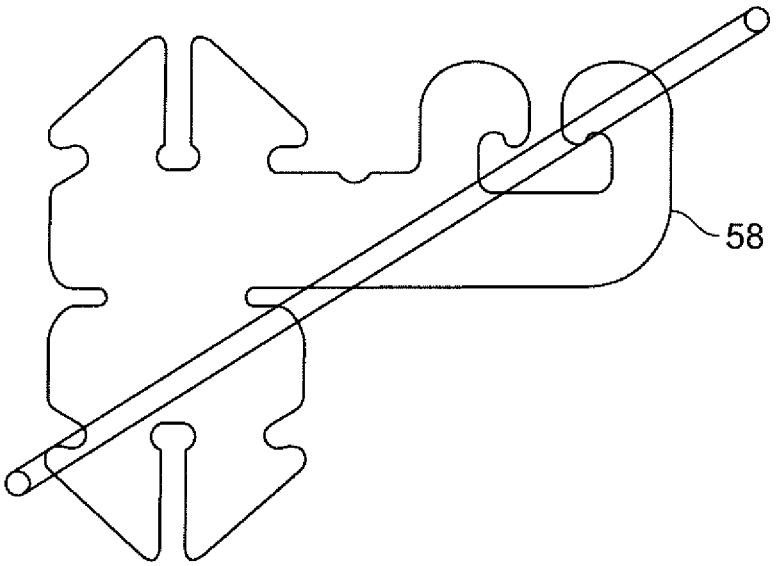
FIG. 7B shows yet another support insulator and resistance wire combination.

FIGS. 7A and 7B shows additional examples of applications for different configurations of support insulators and resistance wire. For example, in FIG. 7A, a horizontal run of a bare resistance wire 51 could be supported using three spaced apart support insulators 53, 55, and 57, with the support insulators also supporting a coil section (not shown) at the same time. FIG. 7B shows a different configuration for the support insulator holding a resistance wire and designated by reference numeral 58.

Figure 8A:
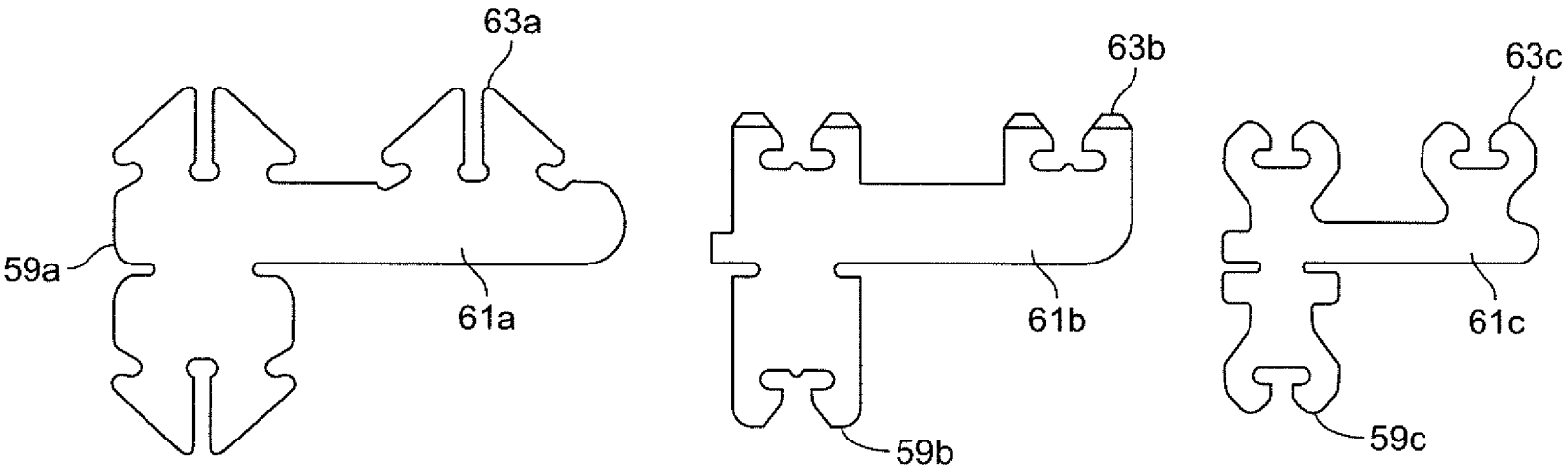
FIG. 8A shows a further embodiment of the inventive support insulator.
Figure 8B:
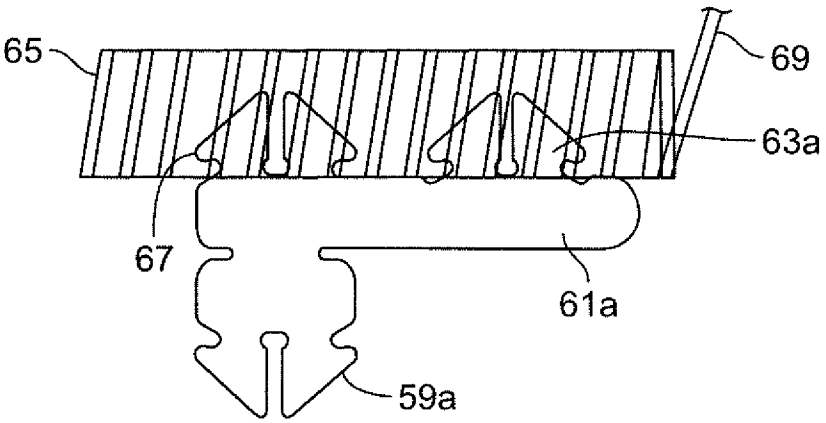
FIG. 8B shows an inventive support insulator holding a coil section.

FIGS. 8A and 8B shows another embodiment of the support insulator, with FIG. 8A showing three support insulators designated by reference numerals 59*a*, 59*b*, and 59*c*. These support insulators each have an extension arm 61*a*, 61*b*, 61*c*, with each extension arm having a third coil support portion 63*a*, 63*b*, 63*c*.

FIG. 88 shows the support insulator 59*a* in an exemplary use, wherein the third coil support portion 63*a* provides additional support for the coil section 65 in addition to the support provided by the coil support portion 67. In the case where a pair of coil sections are mounted on one side of a metal plate and a resistance wire 69 extends between the adjacent coil sections, a pair of support insulators 59*a* could be used for each coil section.

Figure 9A:
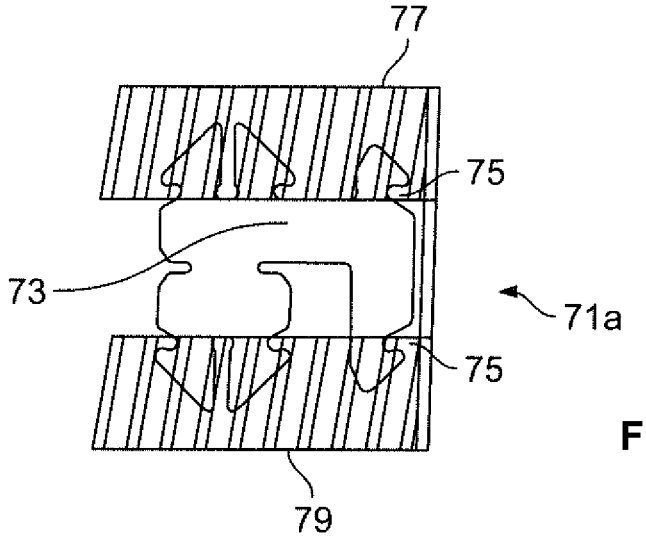
FIGS. 9A-9C show different support insulator and coil section attachments.
Figure 9B:
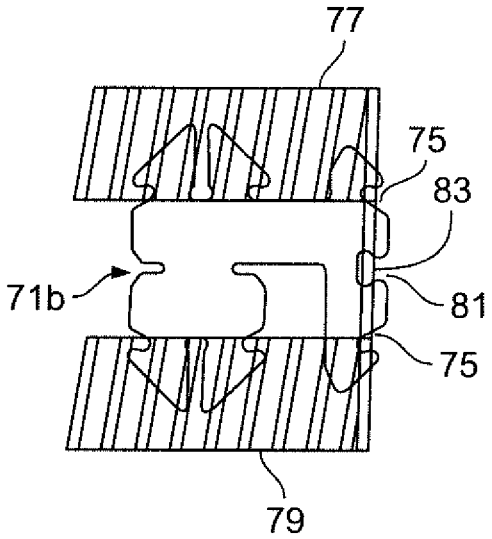
Figure 9C:
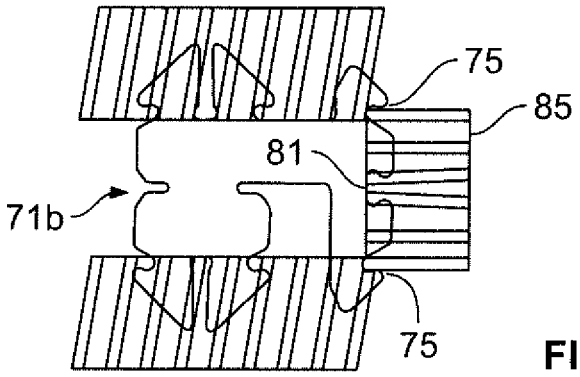

The extension arm of the support insulator could have more than one slot as shown in the embodiments of FIGS. 9A-C, which shows two different configurations of support insulators designed as 71*a* and 71*b*. For support insulator 71*a* in FIG. 9A, the extension arm 73 has a pair of slots 75, with each slot supporting a part of each of the coil sections 77 and 79 (the metal plate separating the coil sections and being attached to the support insulator 71*a* is not shown). Here, the coil return bend is free but the coil itself is additionally supported and fastened in place.

The support insulator 71*b* of FIG. 9B provides a dual function by having an additional slot 81. The slot 81 captures a part of the coil break-turn wire 83 to prevent short circuiting and the slots 75 provide additional support for the coil sections 77 and 79. Here, the return bend could be captured and secured on its own or additionally, the main coil helices could be additionally supported and fastened as needed.

Referring to FIG. 9C, the support insulator 71*b* can also be used to support a coil break-turn that is a return section of coil 85 with the multiple slots 75 and 81 rather than just the coil breakturn wire 83. Here, the coil could be additionally designed to capture a short section of coil as a cross-over rather than a return bend section of more straightened wire.

Figures 10A, 10B:
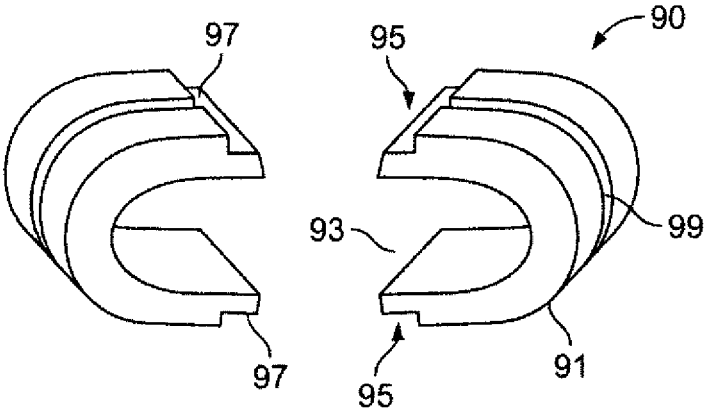
FIGS. 10A-10B show another type of support insulator for short circuit protection.

FIGS. 10A and B show another embodiment of the invention in two different views for preventing short circuiting in an open coil electric heater. This embodiment is designated by the reference numeral 90 and has an insulator body 91 that forms an open-ended channel 93. The insulator body 91 has two outer ends 95, with each outer end having a recess 97. The outer surface of the body 91 extending between the two recesses 97 includes a groove 99 therein.

Figure 11A:
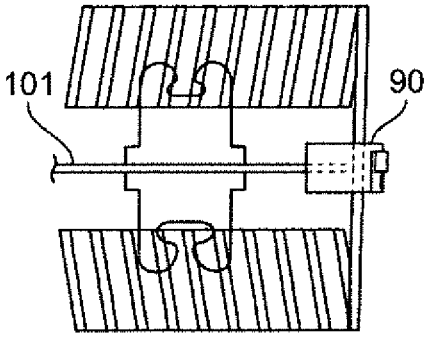
FIG. 11A shows the support insulator of FIG. 10A in use with a coil section.
Figure 11B:
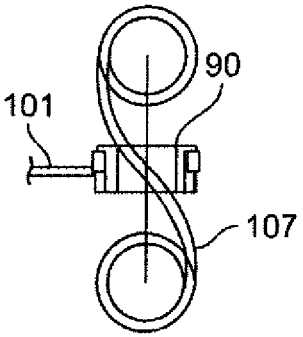
FIG. 11B is a side view of the arrangement of FIG. 11A.
Figure 11C:
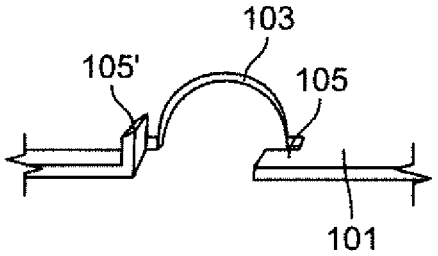
FIG. 11C shows a portion of a metal plate of a heater that is configured to engage with the support insulator of FIG. 11A.

FIGS. 11A-11C show the support insulator 90 attached to the metal plate 101 of a heater. The metal plate 101 has a cutout 103 and pair of locking tabs 105 made from the plate itself. Once the support insulator 90 is positioned in the cutout 103 so that the groove 99 engages the edge 105 of the cutout 103, the locking tabs are bent to engage the recesses 95 to keep the support insulator 90 in place. FIG. 11C shows one locking tab 105 in the unbent position and another locking tab 105' in the bent position to hold the support insulator once located in the cutout 103.

With the support insulator 90 in place, the open-ended channel 93 can capture a part of the coil breakturn 107 and prevent short circuiting by contact between the coil breakturn and the metal plate.

Figure 12A:
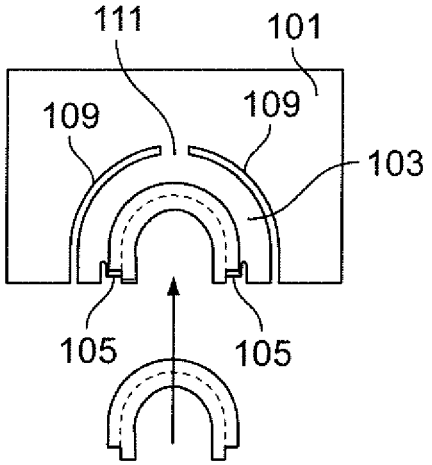
FIGS. 12A-12C show another configuration and use of the metal plate for engagement with the support insulator of FIG. 10.
Figure 12B:
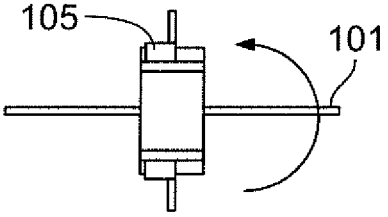
Figure 12C:
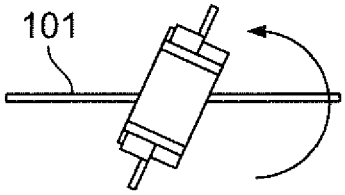

FIGS. 12A-C show another embodiment of the support insulator 90. In this embodiment, the metal plate 101 has the cutout 103 and a pair of slots 109 that form a pivot area 111. Once the support insulator is positioned in the cutout and secured using the locking tabs 105, the support insulator can be moved about the pivot area 111 and change its orientation from its horseshoe shape being parallel to the plane of the metal plate to being perpendicular to the plate, see FIG. 12B, or at an angle to the metal plate, see FIG. 12C.

Figure 13A:
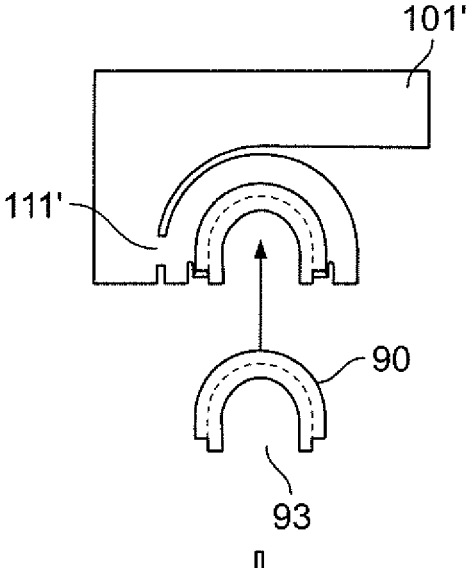
FIGS. 13A-13C shows yet another configuration of the metal plate for engagement with a support insulator.
Figure 13B:
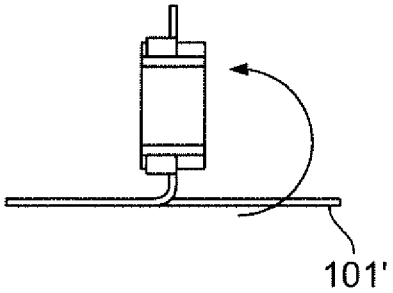
Figure 13C:
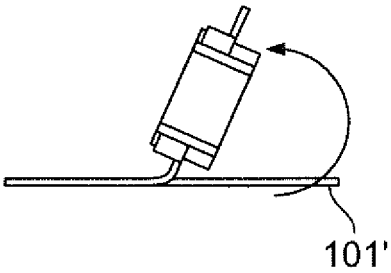

FIGS. 13A-C show another arrangement of an adjustable support insulator. Here, the metal plate 101' is configured so that the pivot area 111' is not centered on the channel 93 but offset. In this way, the support insulator can be moved out of the plane of the plate but perpendicular to the plane of the plate, see FIG. 13B, or out of the plane of the plate but angled with respect to the plane of the plate, see FIG. 13C.

The adjustability of the support insulator provides a significant advantage in that the location of the channel can be changed to fit a particular application, e.g., receive a coil break-turn or coil, receive a resistance wire or lead wire in a cross over configuration or just as a straight run, or even provide support for a coil section.

While a groove on the outer surface of the support insulator and locking tabs on the plate are used to keep the support insulator in place on the metal plate, any kind of a means for locking the support insulator into the metal plate cutout could be used as long as it keeps the support insulator securely in place on the metal plate, e.g., a press fit, fasteners, locking tabs created from an internal part of the metal plate instead of an edge, and the like.

Figure 14:
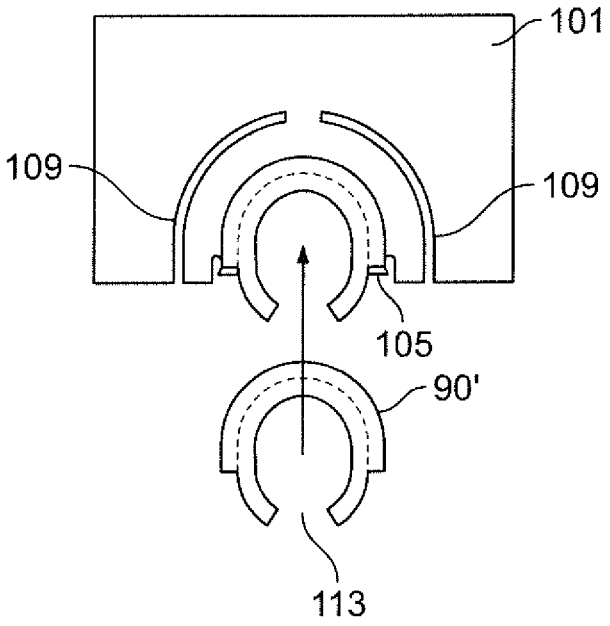
FIG. 14 shows a second embodiment of the support insulator of FIG. 10.

The shape of the support insulator can also be varied. FIG. 14 shows a different shaped channel 113 for support insulator 90' in an application as shown for the adjustable embodiment of FIG. 12A. Here, the open end of the channel 113 is narrowed to not only receive a resistance wire but better retain it once received. This configuration can also be used in the non-adjustable mounting of FIGS. 11A-C.

Figure 15A:
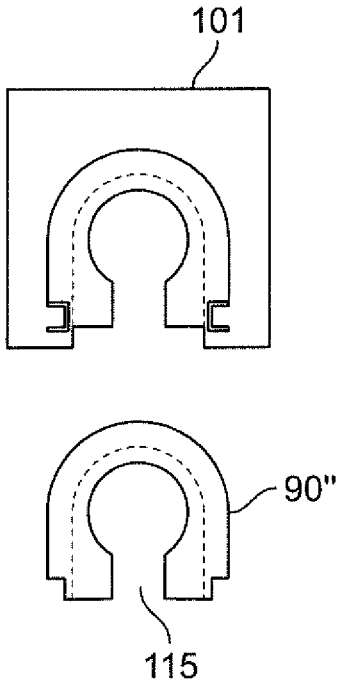
FIGS. 15A-B show a third embodiment of the support insulator of FIG. 10.
Figure 15B:
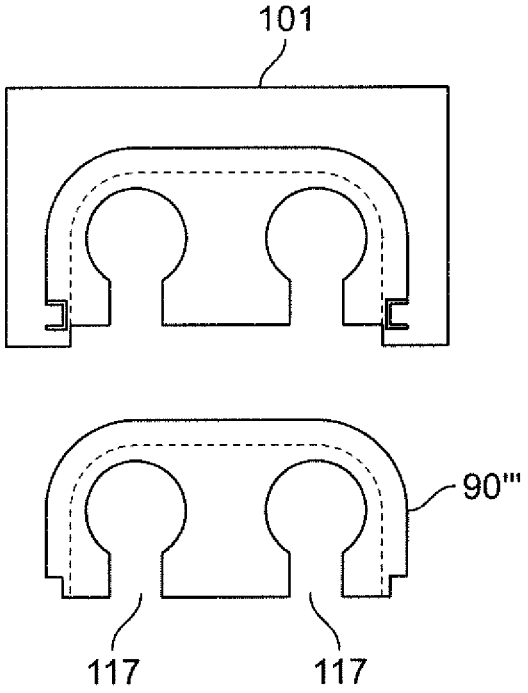

FIG. 15A shows a keyhole-shaped channel 115 for a support insulator 90". FIG. 15B shows a support insulator 90'" that has two channels 117 but even more channels could be employed if an application required more.

Figure 16A:
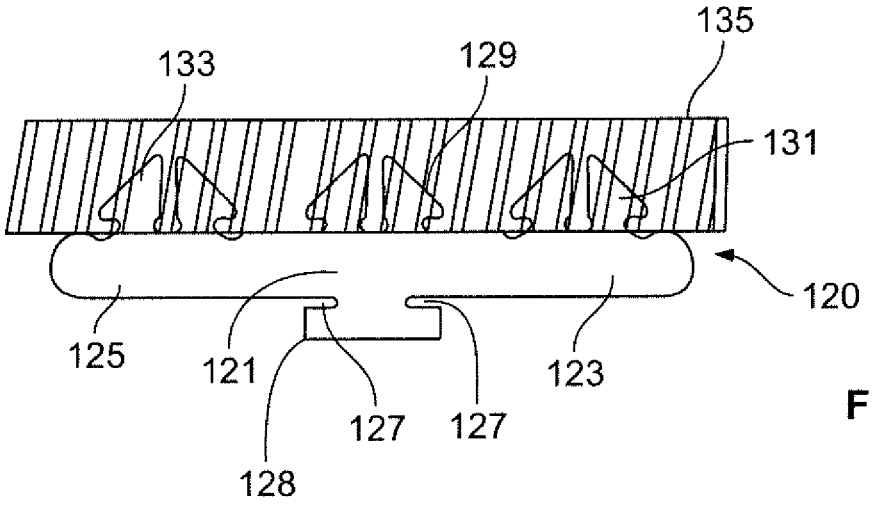
FIGS. 16A-16C show another embodiments of the support insulator of FIG. 1.
Figure 16B:
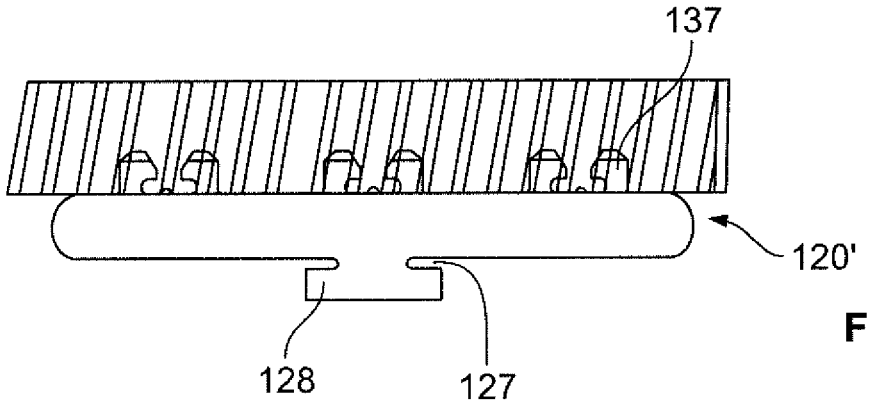
Figure 16C:
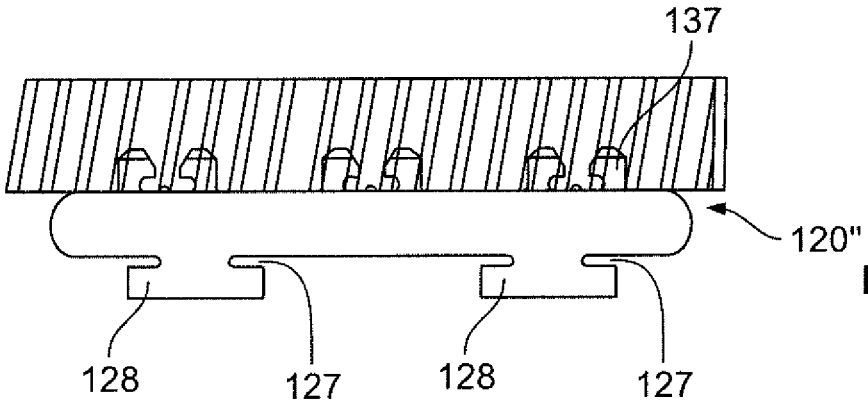

FIGS. 16A-C show yet another embodiment of the invention. In FIG. 16A, a support insulator 120 is shown with an insulator body 121 and two extension arms 123 and 125 extending therefrom. The insulator body 121 is the type that has plate attachment slots 127 that are part of a bottom portion 128, but one coil support portion 129. Each extension arm 123 and 125 has its own coil support portion 131 and 133. In this embodiment, the support insulator can provide support over a longer (or entire) length of a coil section 135 with only one bottom portion 128, thus saving cost by using less ceramic for the support insulators. That is, instead of three separate support insulators to support the coil section 135 with three bottom portions and three sets of attachment slots, the support for a coil section can be obtained using just one bottom portion.

FIG. 16B shows a similar design 120' as FIG. 16A but with differently configured coil support portions 137'.

FIG. 16C shows a support insulator similar to that of FIG. 16B in terms of the configuration of the coil support portion 137 but it has two bottom portions 128, instead of one like in FIGS. 16A and 16B.

The support insulator 90 could also be sized to receive a coil section rather than just a resistance wire. That is, the size of the channel would be such that it would receive a part of the coil rather than just a resistance wire.

As such, an invention has been disclosed in terms of preferred embodiments thereof which fulfills each and every one of the objects of the present invention as set forth above and provides new and improved support insulators for open coil electric heaters and methods of use.

Of course, various changes, modifications and alterations from the teachings of the present invention may be contemplated by those skilled in the art without departing from the intended spirit and scope thereof. It is intended that the present invention only be limited by the terms of the appended claims.

We claim:

1. An open coil electric heater support insulator comprising:

an insulator body having a longitudinal axis and a first portion including metal plate attachment slots, the insulator body made from a ceramic material and further comprising:

a first coil support portion having at least one first coil support slot therein; and at least one extension arm extending from the insulator body, the at least one extension arm having at least one extension arm slot at an end thereof.

2. The support insulator of claim 1, further comprising a plurality of extension arm slots and/or a plurality of bottom portions and/or a plurality of extension arms.

3. The support insulator of claim 1, wherein the extension arm slot extends in a direction parallel to the longitudinal axis, perpendicular to the longitudinal axis, or at an angle between 0 and 90° with respect to the longitudinal axis.

4. The support insulator of claim 1, wherein the insulator body comprises first and second coil support portions.

5. The support insulator of claim 4, wherein the first and second coil support portions are offset from each other with respect to the longitudinal axis.

6. The support insulator of claim 1, wherein the extension arm has a coil support portion.

7. The support insulator of claim 6, wherein a configuration of the coil support portion of the extension arm has a configuration that matches a configuration of the first coil support portion.

8. The support insulator of claim 1, further comprising a second coil support portion having at least one second coil support slot therein.

9. The support insulator of claim 8, wherein the extension arm has a coil support portion and a configuration of the coil support portion of the extension arm has a configuration that matches a configuration of either or both of the first and second coil support portions.

10. A method of securing a coil break-turn in an open coil electric heater comprising:

a) mounting a support insulator comprising an insulator body having a longitudinal axis and a bottom portion including metal plate attachment slots, the insulator body made from a ceramic material and further comprising: a first coil support portion having at least one first coil support slot therein; and at least one extension arm extending from the insulator body, the at least one extension arm having at least one extension arm slot at an end thereof on a metal plate of the open coil electric heater and receiving a part of coil breakturn in the extension arm slot.

11. The method of claim 10, wherein the extension arm has a coil support portion.

12. The method of claim 11, wherein a configuration of the coil support portion of the extension arm has a configuration that matches a configuration of the first coil support portion.

13. The method of claim 10, wherein the insulator body further comprises a second coil support portion having at least one second coil support slot.

14. The method of claim 13, wherein the extension arm has a coil support portion and a configuration of the coil support portion of the extension arm has a configuration that matches a configuration of either or both of the first and second coil support portions.

15. An open coil electric heater having at least one insulator support, the at least one insulator support comprising:

an insulator body having a longitudinal axis and a bottom portion including metal plate attachment slots, the insulator body made from a ceramic material and further comprising:

a first coil support portion having at least one first coil support slot therein; and at least one extension arm extending from the insulator body, the at least one extension arm having at least one extension arm slot at an end thereof.

16. The open coil heater of claim 15, wherein the extension arm has a coil support portion.

17. The open coil heater of claim 16, wherein a configuration of the coil support portion of the extension arm has a configuration that matches a configuration of the first coil support portion.

18. The open coil electric heater of claim 15, further comprising a second coil support portion having at least one second coil support slot therein.

19. The open coil heater of claim 18, wherein the extension arm has a coil support portion and a configuration of the coil support portion of the extension arm has a configuration that matches a configuration of either or both of the first and second coil support portions.

* * * * *